US010062998B2

(12) United States Patent
Sekino et al.

(10) Patent No.: US 10,062,998 B2
(45) Date of Patent: Aug. 28, 2018

(54) CONNECTOR HAVING A SHORT CIRCUIT TERMINAL

(71) Applicants: Yazaki Corporation, Tokyo (JP); TOYOTA JIDOSHA KABUSHIKI KAISHA, Toyota-shi, Aichi-ken (JP)

(72) Inventors: Tetsuya Sekino, Makinohara (JP); Hiroshi Kobayashi, Okazaki (JP); Takeshi Misaiji, Seto (JP)

(73) Assignees: YAZAKI CORPORATION, Minato-ku, Tokyo (JP); TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 0 days.

(21) Appl. No.: 15/639,096

(22) Filed: Jun. 30, 2017

(65) Prior Publication Data

US 2018/0034184 A1 Feb. 1, 2018

(30) Foreign Application Priority Data

Jul. 29, 2016 (JP) ..... 2016-149198

(51) Int. Cl.

| | |
|---|---|
| ***H01R 13/26*** | (2006.01) |
| ***H01R 13/428*** | (2006.01) |
| ***H01R 13/502*** | (2006.01) |
| ***H01R 13/516*** | (2006.01) |
| ***H01R 31/08*** | (2006.01) |

(52) U.S. Cl.

CPC ..... *H01R 13/428* (2013.01); *H01R 13/26* (2013.01); *H01R 13/502* (2013.01); *H01R 13/516* (2013.01); *H01R 31/08* (2013.01)

(58) Field of Classification Search

CPC .. H01R 13/7032; H01R 31/08; H01R 13/428; H01R 13/26; H01R 13/502; H01R 13/516

See application file for complete search history.

(56) References Cited

U.S. PATENT DOCUMENTS 4,850,888 A * 7/1989 Denlinger ..... H01R 13/7032 439/188

5,647,754 A * 7/1997 Kohno ..... H01R 13/7032 200/51.1

(Continued)

FOREIGN PATENT DOCUMENTS

JP 2007-073268 A 3/2007

*Primary Examiner* — Edwin A. Leon
*Assistant Examiner* — Oscar Jimenez
(74) *Attorney, Agent, or Firm* — Sughrue Mion, PLLC

(57) ABSTRACT

A connector includes: a short circuit terminal housed in a first housing and having contact pieces contacting with adjacent first terminals of a plurality of first terminals respectively with the first housing and a second housing not being engaged with each other; and a releaser provided in the second housing and configured to displace the contact pieces and release contact between the adjacent first terminals and the contact pieces upon engaging of the first housing and the second housing. The contact pieces include: contact portions contactable with the adjacent first terminals respectively; and slide portions slidable on the releaser and respectively arranged in positions anterior to the contact portions in an engaging direction of the first housing and the second housing. The contact portions are apart from the releaser with the contact pieces being displaced due to slide of the slide portions on the releaser.

3 Claims, 10 Drawing Sheets

(56) References Cited

U.S. PATENT DOCUMENTS 5,944,547 A * 8/1999 Golab ..... H01R 13/7032 200/51.1
6,036,515 A * 3/2000 Nakamura ..... H01R 13/7032 439/188
6,488,520 B1 * 12/2002 Hayes ..... H01R 13/4365 439/188
6,520,786 B2 * 2/2003 Nakamura ..... H01R 13/6271 439/188
6,942,510 B2 * 9/2005 Nakamura ..... H01R 13/7032 439/188
7,008,258 B2 * 3/2006 Nakamura ..... H01R 13/6272 439/489
2002/0115322 A1 * 8/2002 Nakamura ..... H01R 13/6271 439/188
2003/0022542 A1 * 1/2003 Nakamura ..... H01R 13/7032 439/188
2004/0132334 A1 * 7/2004 Nakamura ..... H01R 13/7031 439/489
2005/0074997 A1 * 4/2005 Nakamura ..... H01R 13/7032 439/188
2007/0054547 A1 3/2007 Ohtaka et al.
2007/0082549 A1 * 4/2007 Fujii ..... H01R 13/62938 439/595
2007/0128932 A1 * 6/2007 Ohtaka ..... H01R 13/701 439/587
2008/0261425 A1 * 10/2008 Nakamura ..... H01R 13/5812 439/188
2008/0261438 A1 * 10/2008 Nakamura ..... H01R 13/5812 439/374
2010/0055972 A1 * 3/2010 Nakamura ..... H01R 13/5812 439/489
2012/0225574 A1 * 9/2012 Nakamura ..... H01R 13/4223 439/345
2013/0040488 A1 * 2/2013 Nakamura ..... H01R 13/4223 439/509
2015/0079827 A1 * 3/2015 Hara ..... H01R 13/05 439/188

* cited by examiner

CONNECTOR HAVING A SHORT CIRCUIT TERMINAL

CROSS REFERENCE TO RELATED APPLICATION

This application is based upon and claims the benefit of priority from the prior Japanese Patent Application No. 2016-149198, filed on Jul. 29, 2016, the entire contents of which are incorporated herein by reference.

BACKGROUND

1. Technical Field

The disclosure relates to a connector, and more particularly to a connector having a short circuit terminal connecting a plurality of terminals accommodated in a housing.

2. Related Art

JP 2007-73268 A describes a connector including a first housing accommodating a plurality of female terminals as first terminals, a second housing that accommodates a plurality of male terminals as second terminals connectable to the female terminals and that is engageable with the first housing, a short circuit terminal accommodated in the first housing and having a contact piece that is in contact with each of the female terminals adjacent to each other, and a release piece as a releaser provided in the second housing and displacing the contact piece to release a contacting state between the female terminal and the contact piece.

In this connector, for example, two adjacent female terminals among the plurality of female terminals housed in the first housing are connected to an air bag circuit that controls the operation of an air bag.

The two adjacent female terminals are connected via the short circuit terminal by coming into contact with the contact piece of the short circuit terminal housed in the first housing in a state where the first housing and the second housing are not engaged with each other.

By thus connecting the two female terminals via the short circuit terminal in the state where the first housing and the second housing are not engaged with each other, no potential difference is generated between the two female terminals, which prevents erroneous inflation of the air bag.

As for the connection between the two female terminals and the short circuit terminal, by engaging the first housing with the second housing, the contact piece of the short circuit terminal is displaced by the release piece of the second housing so that the contacting state between the female terminal and the contact piece is released and the connection between the two female terminals and the short circuit terminal is released.

SUMMARY

By the way, in the above-described connector, when the contact piece of the short circuit terminal is displaced by the releaser of the second housing, the contact piece is displaced by a slide, on the releaser, of the contact portion provided on the contact piece and contactable with the first terminal.

When the contact portion of the contact piece slides on the releaser similarly to the above connector, the contact portion may be deformed or an insulating substance attached to the releaser may adhere to the contact portion.

In such a case, when the engagement between the first housing and the second housing is released and the contact portion and the first terminal are brought into contact with each other, there may be cases where the contact portion and the first terminal do not come in contact normally, or an insulating substance is interposed between the contact portion and the first terminal, so that the electrical performance of the short circuit terminal may be deteriorated.

An object of the disclosure is to provide a connector capable of maintaining electrical performance by the short circuit terminal.

A connector in accordance with some embodiments includes: a first housing; a plurality of first terminals housed in the first housing; a second housing engageable with the first housing; a plurality of second terminals housed in the second housing and connected to the plurality of first terminals respectively with the first housing and the second housing being engaged with each other; a short circuit terminal housed in the first housing and having contact pieces contacting with adjacent first terminals of the plurality of first terminals respectively with the first housing and the second housing not being engaged with each other; and a releaser provided in the second housing and configured to displace the contact pieces and release contact between the adjacent first terminals and the contact pieces upon engaging of the first housing and the second housing. The contact pieces include: contact portions contactable with the adjacent first terminals respectively; and slide portions slidable on the releaser and respectively arranged in positions anterior to the contact portions in an engaging direction of the first housing and the second housing. The contact portions are apart from the releaser with the contact pieces being displaced due to slide of the slide portions on the releaser.

According to the above configuration, the contact pieces include: contact portions contactable with the adjacent first terminals respectively; and slide portions slidable on the releaser and respectively arranged in positions anterior to the contact portions in an engaging direction of the first housing and the second housing. Therefore, when the first housing and the second housing become engaged with each other, the slide portions slide on the releaser and the contact portions do not slide on the releaser so that deformation due to the sliding of the contact portions on the releaser can be prevented.

The contact portions are arranged away from the releaser when the slide portions slide on the releaser and the contact pieces are displaced. Therefore, in the state where the first housing and the second housing are engaged with each other, the contact portions do not come into contact with the releaser, and an insulating substance attached to the releaser can be prevented from adhering to the contact portions.

Accordingly, in a state in which the engagement between the first housing and the second housing has been released, the contact portions and the first terminals are normally brought into contact with each other, and an insulating substance is not interposed between the contact portions and the first terminals, and thus, electric performance by the short circuit terminal can be maintained.

The releaser may include an insulation portion arranged in between the contact portions and the adjacent first terminals with the first housing and the second housing being engaged with each other.

According to the above configuration, the insulating performance between the contact portions and the first terminals can be improved, and conduction between the short circuit terminal and the first terminals can be prevented.

DETAILED DESCRIPTION

Figure 1:
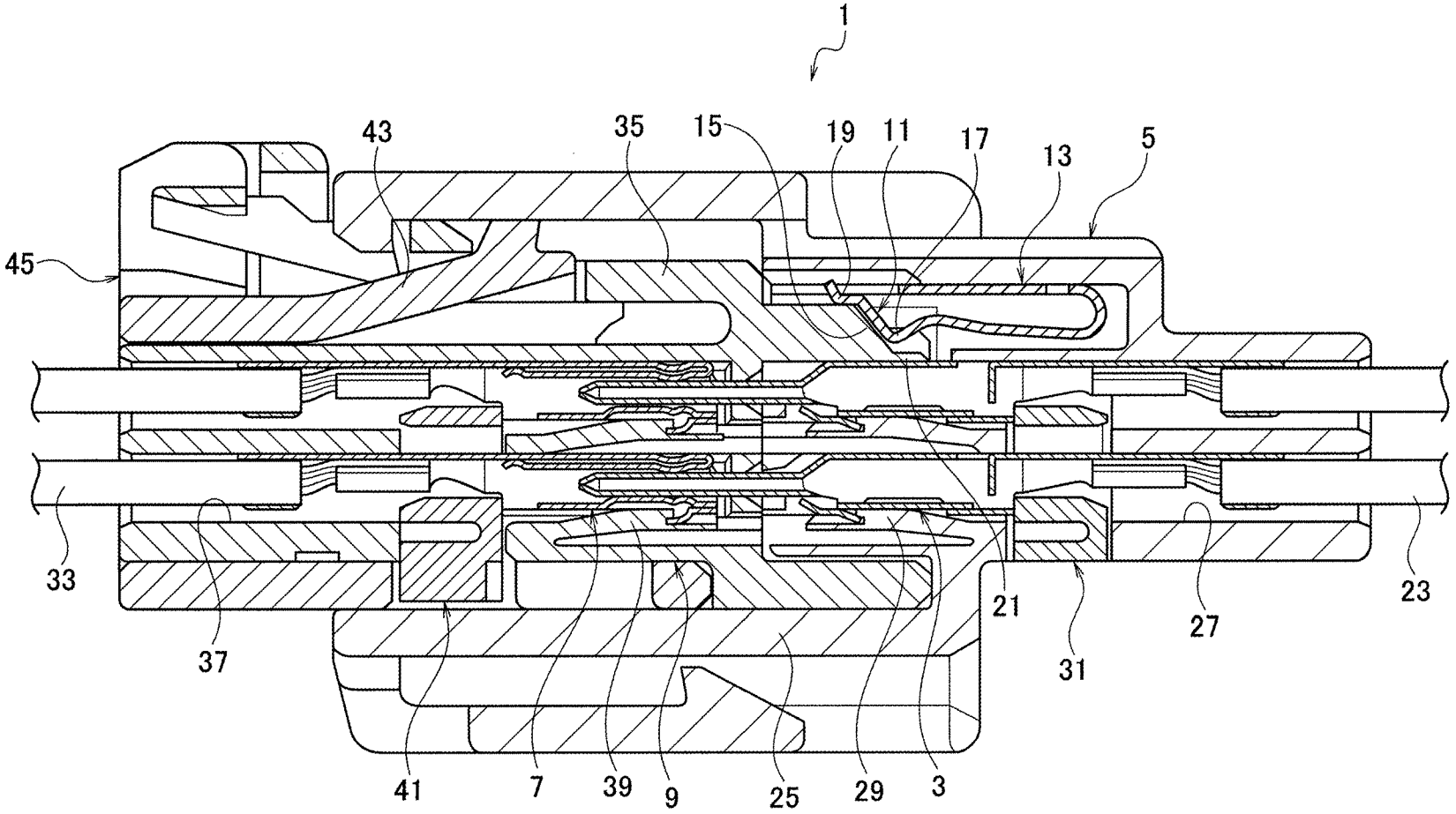
FIG. 1 is a cross-sectional view of a connector according to an embodiment of the present invention.
Figure 2:
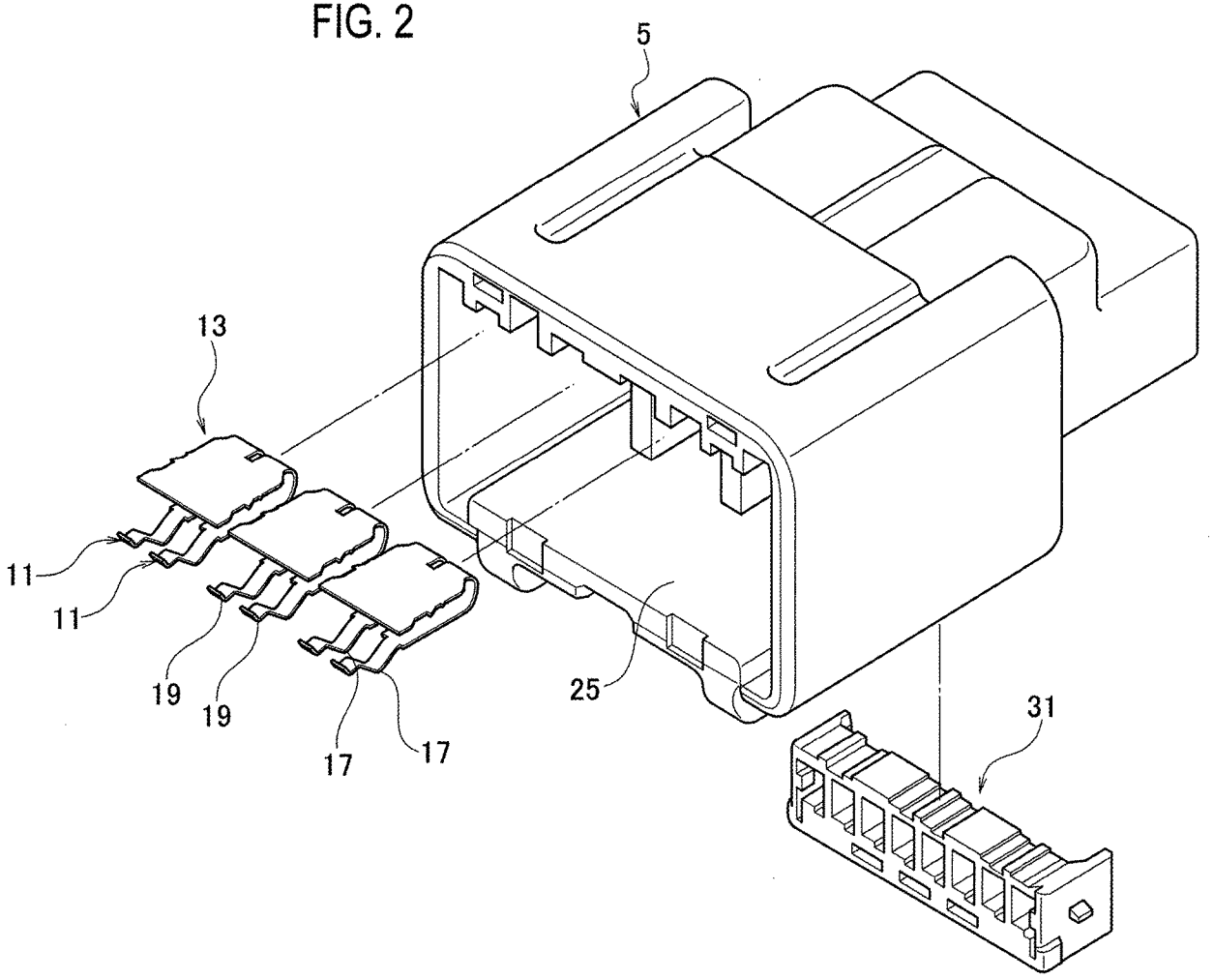
FIG. 2 is an exploded perspective view of a first housing of the connector according to the embodiment.
Figure 3:
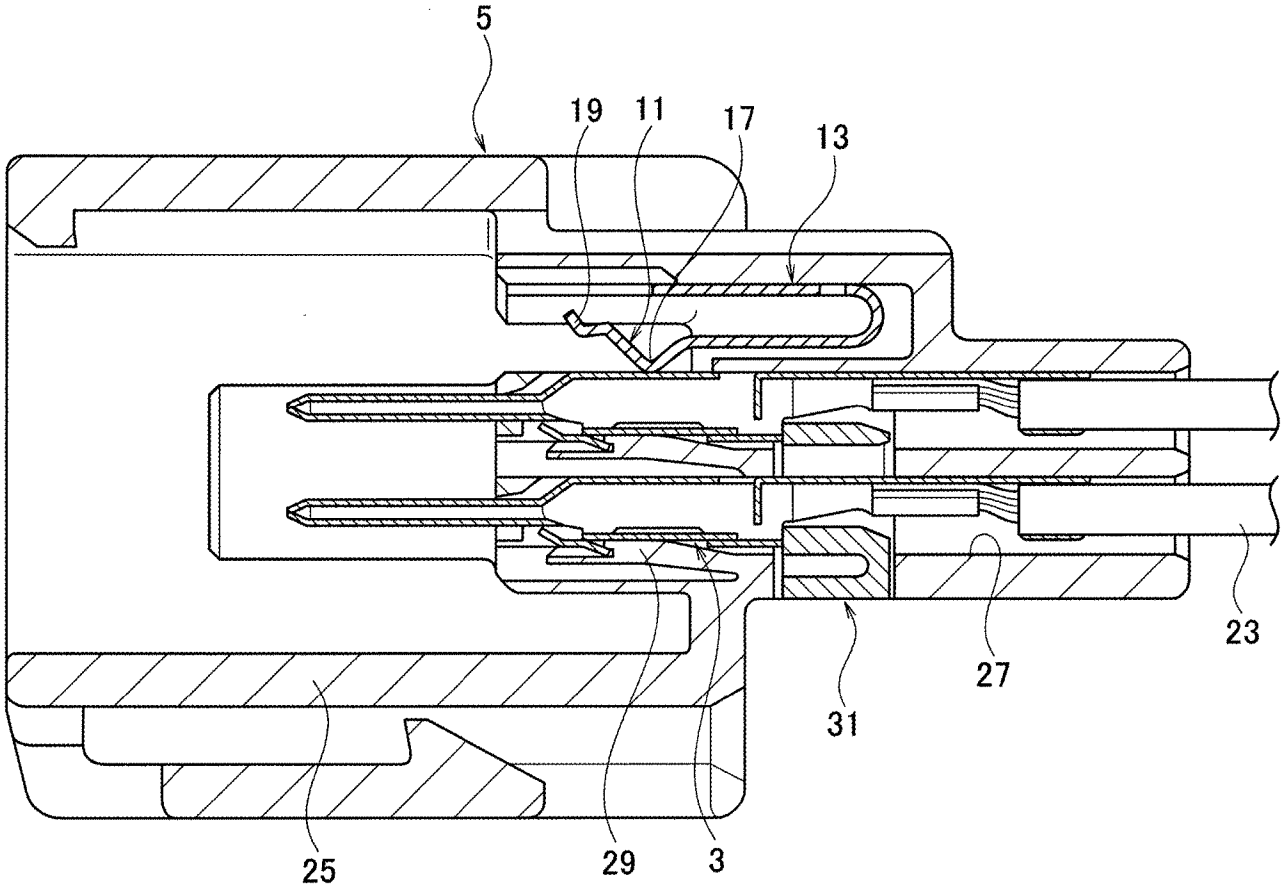
FIG. 3 is a cross-sectional view of the first housing of the connector according to the embodiment.
Figure 4:
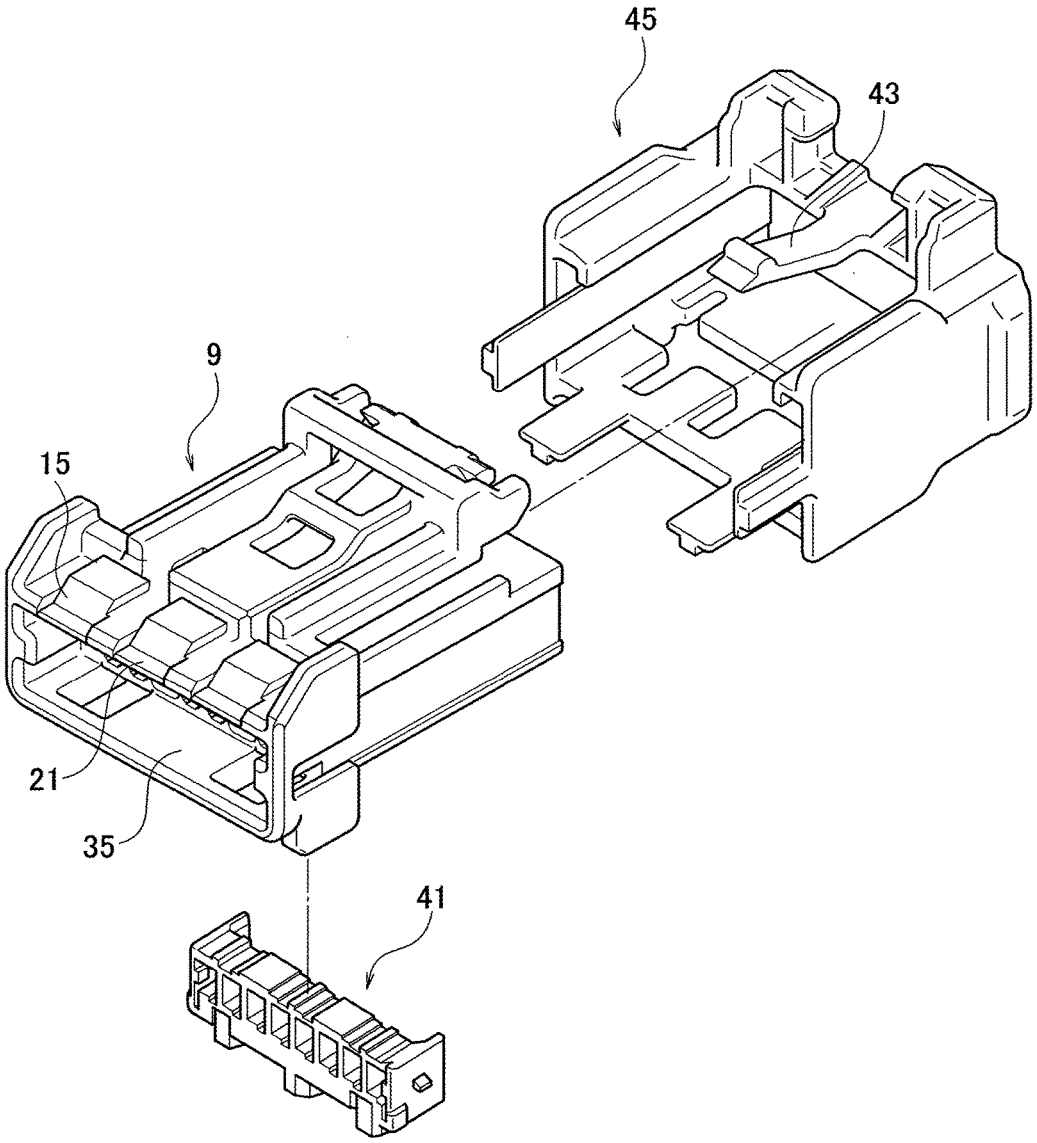
FIG. 4 is an exploded perspective view of a second housing of the connector according to the embodiment.
Figure 5:
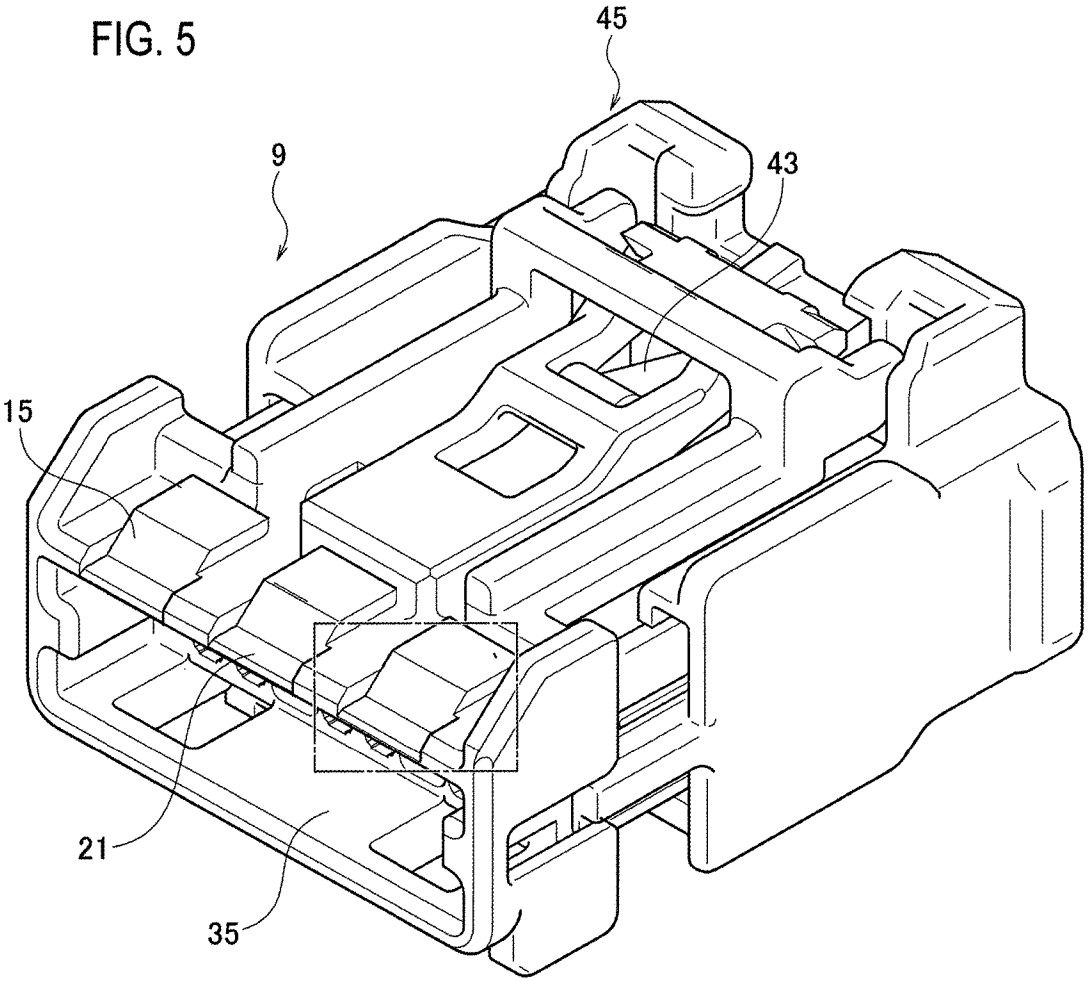
FIG. 5 is a perspective view of the second housing of the connector according to the embodiment.
Figure 6:
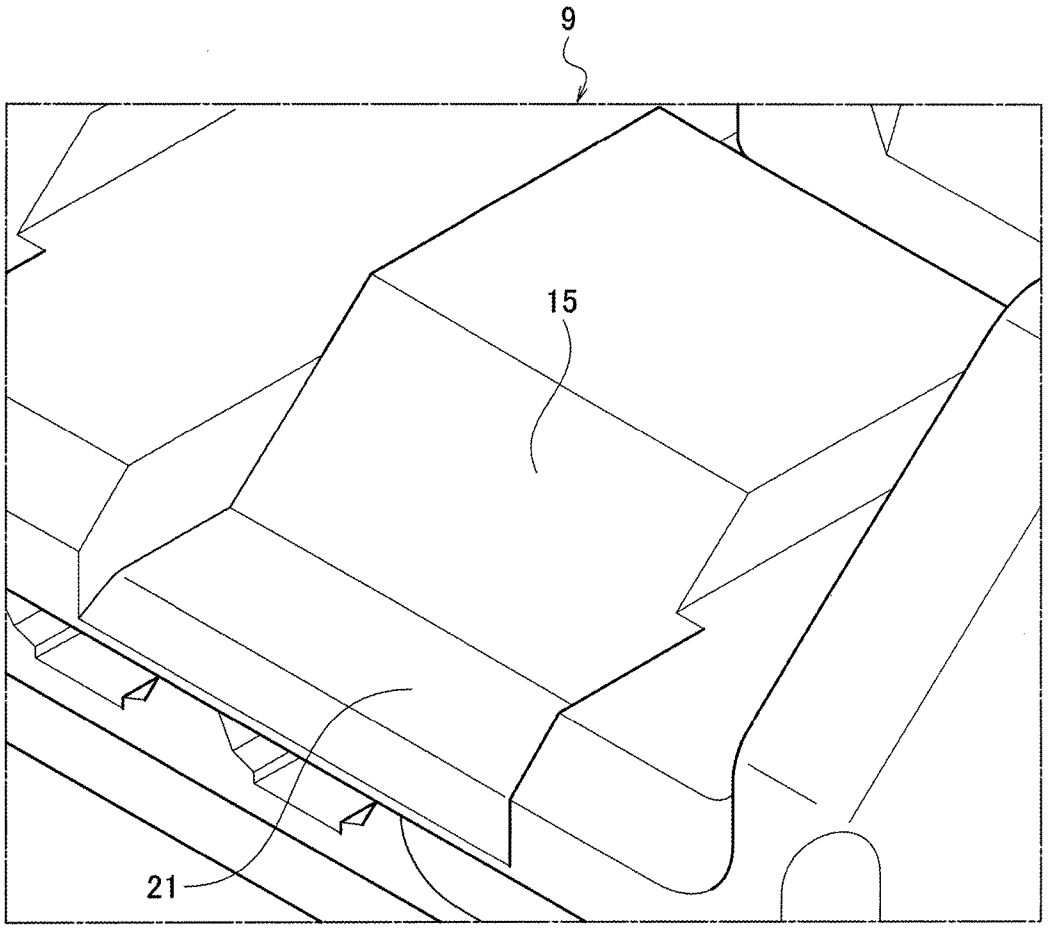
FIG. 6 is an enlarged view of a main part of FIG. 5.
Figure 7:
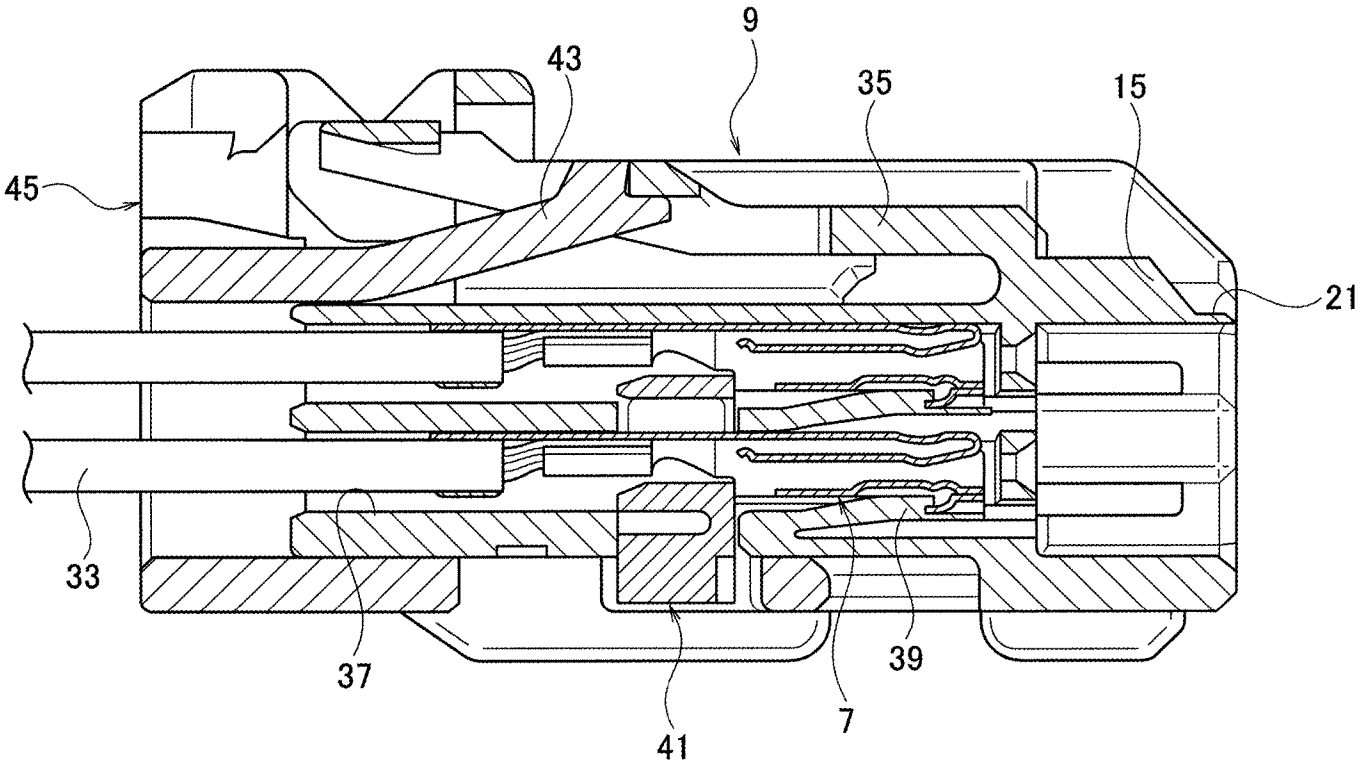
FIG. 7 is a cross-sectional view of the second housing of the connector according to the embodiment.
Figure 8B:
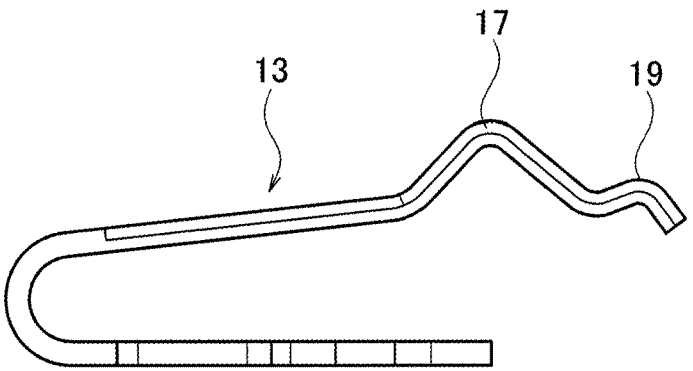
FIG. 8B is a side view of the short circuit terminal of the connector according to the embodiment.
Figure 8A:
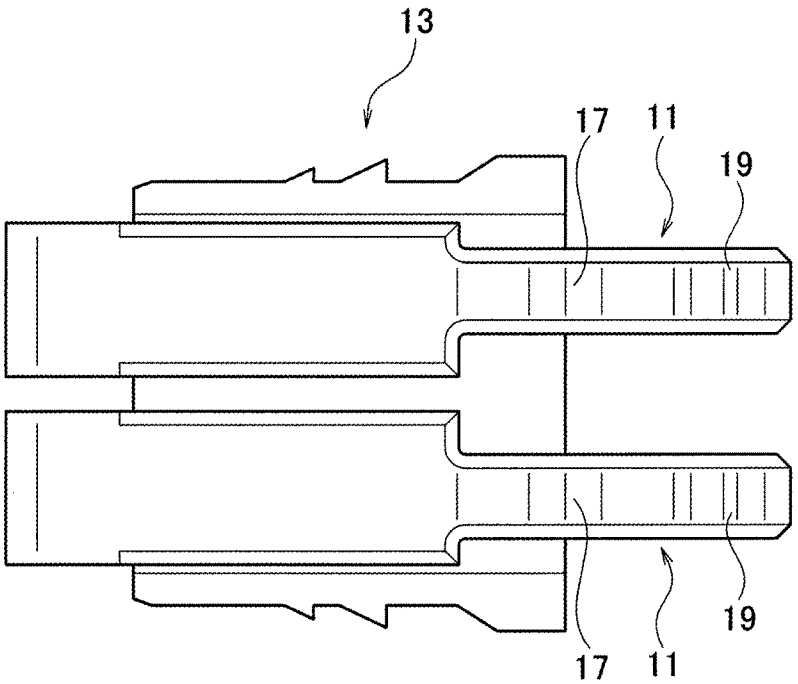
FIG. 8A is a plan view of a short circuit terminal of the connector according to the embodiment.
Figure 9:
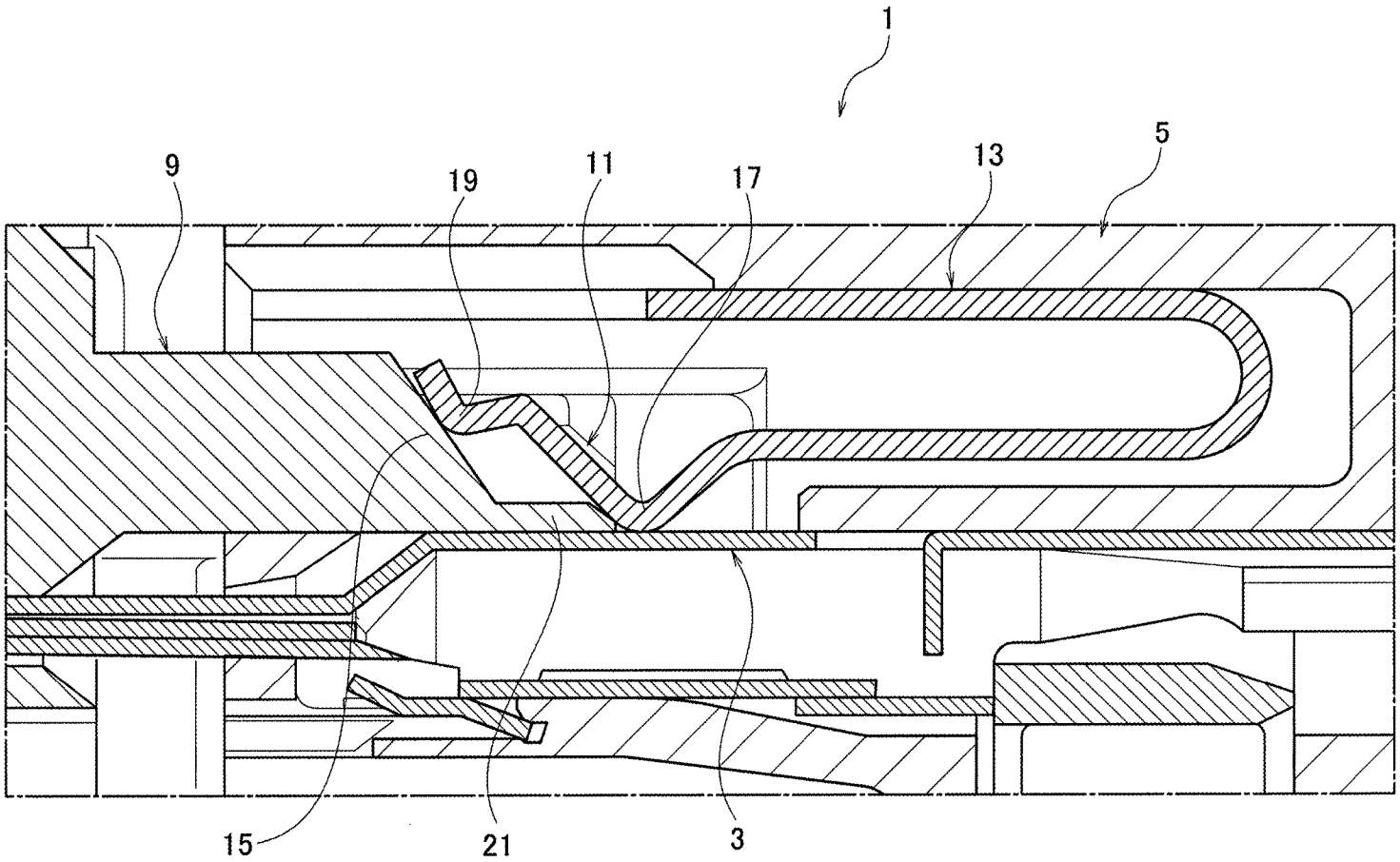
FIG. 9 is an enlarged cross-sectional view of a main part when the first housing and the second housing of the connector according to the embodiment are to be engaged with each other.
Figure 10:
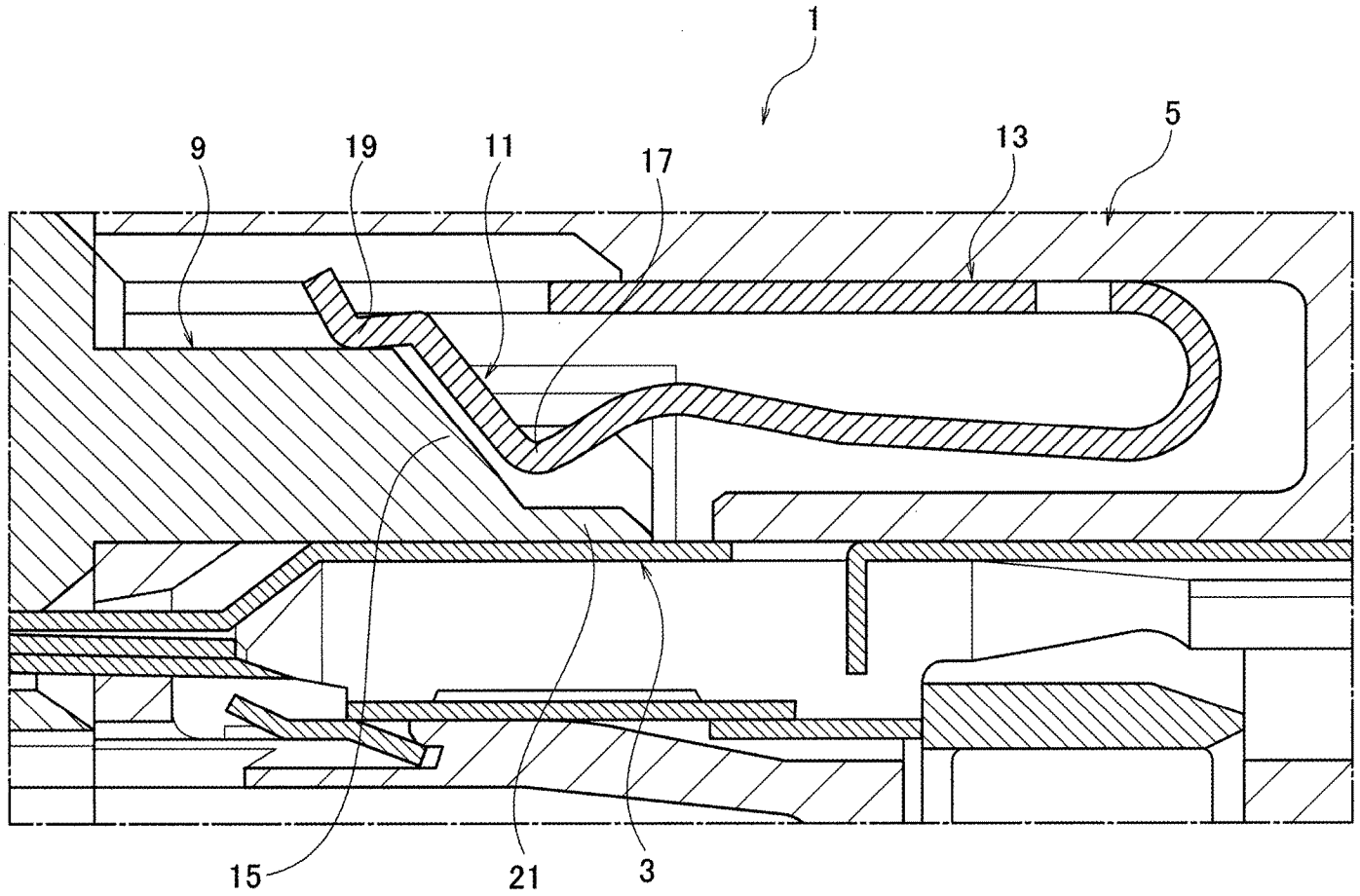
FIG. 10 is an enlarged cross-sectional view of the main part when the first housing and the second housing of the connector according to the embodiment are engaged with each other.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

A connector 1 according to an embodiment of the present invention will be described with reference to FIGS. 1 to 10.

The connector 1 includes a first housing 5 that houses a plurality of first terminals 3, a second housing 9 that houses a plurality of second terminals 7 connectable to the first terminals 3 and that is engageable with the first housing 5, a short circuit terminal 13 housed in the first housing 5 and having contact pieces 11, 11 which are in contact with adjacent first terminals 3, 3 respectively, and a releaser 15 provided in the second housing 9 for displacing the contact piece 11 to release the contacting state between the first terminal 3 and the contact piece 11.

The contact piece 11 includes a contact portion 17 provided so as to be contactable with the first terminal 3, and a slide portion 19 positioned on the front side of the contact portion 17 in the engaging direction of the first housing 5 and the second housing 9 and provided to be slidable on the releaser 15.

The contact portion 17 is arranged to be apart from the releaser 15 when the slide portion 19 slides on the releaser 15 and the contact piece 11 is displaced.

The releaser 15 is provided with an insulation portion 21 positioned between the contact portion 17 and the first terminal 3 in the state where the first housing 5 and the second housing 9 are engaged with each other.

As shown in FIGS. 1 to 10, each of the plurality of first terminals 3 is composed of a male terminal having a tab-shaped connection portion. The plurality of first terminals 3 are respectively electrically connected to terminal portions of a plurality of electric wires 23 connected to an air bag circuit for controlling the operation of an air bag.

The plurality of first terminals 3 are inserted into the first housing 5 through openings formed in the first housing 5 and housed in the first housing 5.

The first housing 5 is made of an insulating material such as a synthetic resin. The first housing 5 is provided with a first engagement portion 25 with which the second housing 9 can be engaged therein, on the side opposite to the openings for inserting the first terminals 3. The first housing 5 is provided with a plurality of first terminal housing chambers 27 for housing the first terminals 3 on the bottom side of the first engagement portion 25.

First locking lances 29 for locking the first terminals 3 respectively are provided so as to be bendable in the plurality of first terminal housing chambers 27 of the first housing 5. By inserting a first spacer 31 into a hole communicating with the plurality of first terminal housing chambers 27, the plurality of first terminals 3 are double locked by the first locking lances 29 and the first spacer 31.

The second housing 9 is engaged with the first engagement portion 25 of the first housing 5 so that the plurality of first terminals 3 housed in the first housing 5 are connected to the plurality of second terminals 7 housed in the second housing 9.

Each of the plurality of second terminals 7 is composed of a female terminal having a box-shaped connection portion into which the tab-shaped connection portion of the first terminal 3 can be inserted. The plurality of second terminals 7 are electrically connected to terminal portions of a plurality of electric wires 33 connected to a power source, a device, or the like, respectively.

The plurality of second terminals 7 are inserted into the second housing 9 through openings formed in the second housing 9, and are housed in the second housing 9.

The second housing 9 is made of an insulating material such as a synthetic resin. The second housing 9 is provided with a second engagement portion 35 that can be inserted into the first engagement portion 25 of the first housing 5 on the side opposite to the openings for inserting the second terminals 7. The second housing 9 is provided with a plurality of second terminal housing chambers 37 for housing the second terminals 7 in the second engagement portion 35.

Second locking lances 39 for locking the second terminals 7 respectively are provided so as to be bendable in the plurality of second terminal housing chambers 37 of the second housing 9. By inserting a second spacer 41 into a hole communicating with the plurality of second terminal housing chambers 37, the plurality of second terminals 7 can be double locked by the second locking lances 39 and the second spacer 41.

A cap housing 45 is assembled into the second housing 9 at the temporary locking position (see FIG. 7) on the outer periphery of the second housing 9 on the pull-out side of the electric wire 33 via a bendable locking portion 43.

When the first housing 5 and the second housing 9 are half-engaged, the cap housing 45 cannot be moved from the temporary locking position, and when the first housing 5 and the second housing 9 are engaged with each other, the locking position of the locking portion 43 shifts to the full locking position (see FIG. 1).

The engagement state between the first housing 5 and the second housing 9 can be detected by the transition between the temporary locking position and the full locking position of the cap housing 45.

By engaging the second engagement portion 35 of the second housing 9 with the first engagement portion 25 of the first housing 5, the first terminals 3 housed in the first housing 5 are electrically connected to the second terminals 7 housed in the second housing 9.

In the state where the engagement between the first housing 5 and the second housing 9 has been released due to a maintenance work or the like, when a potential difference is generated by static electricity or the like between the plurality of first terminals 3 housed in the first housing 5 and connected to an air bag circuit, there is a risk that the air bag will be erroneously inflated.

Therefore, in order to prevent a potential difference from generating between the plurality of first terminals 3, the plurality of short circuit terminals 13 for electrically connecting two adjacent first terminals 3, 3 among the plurality of first terminals 3 are housed in the first housing 5.

Each of the plurality of short circuit terminals 13 is made of a single conductive material subjected to press working or bending. Each of the plurality of short circuit terminals has two contact pieces 11, 11 which are elastically deformable at the end thereof.

The contact piece 11 is provided so as to be elastically deformable in the vertical direction. The contact piece 11 has the contact portion 17 protruding toward the first terminal 3 on the free end side in a state of being housed in the first housing 5.

The contact portion 17 is brought into contact with the outer peripheral surfaces of the two adjacent first terminals 3, 3 by a predetermined urging force of the contact piece 11, and the two adjacent first terminals 3, 3 are electrically connected via the short circuit terminal 13.

By thus electrically connecting the two first terminals 3, 3 via the short circuit terminal 13, there is no potential difference between the two first terminals 3, 3, so that an erroneous inflation of the air bag can be prevented.

The slide portion 19 protruding toward the first terminal 3 is provided on the free end of the contact piece 11 which is on the front side of the contact portion 17 in the engaging direction of the first housing 5 and the second housing 9.

When the first housing 5 and the second housing 9 become engaged with each other, the slide portion 19 slides on the releaser 15 provided in the second housing 9 while being in contact with the releaser 15 so as to displace the contact piece 11, and in the state where the first housing 5 and the second housing 9 are engaged with each other, the contact with the releaser 15 is maintained so that the displacement of the contact piece 11 is maintained, and thereby, the contacting state between the contact portion 17 and the first terminal 3 is released.

A plurality of releasers 15 are formed of a member continuous with the second housing 9 and arranged on the front side of the second housing 9 in the engaging direction of the second housing 9 with the first housing 5. The releasers 15 are arranged at positions so as to be able to come in contact with the slide portions 19 of the contact pieces 11 of the plurality of short circuit terminals 13 housed in the first housing 5 when the second housing 9 is engaged with the first housing 5.

The releaser 15 has, on the first housing 5 side, an inclined surface ascending from the first housing 5 side toward the second housing 9 side. The inclined surface of the releaser 15 has a width enough to come in contact with the slide portions 19, 19 of the two contact pieces 11, 11 of the short circuit terminal 13.

When the first housing 5 and the second housing 9 become engaged with each other, the lower end of the inclined surface of the releaser 15 comes in contact with the slide portion 19 of the contact piece 11 of the short circuit terminal 13, and as the engaging motion between the first housing 5 and the second housing 9 proceeds, the slide portion 19 slides along the inclined surface, and the contact piece 11 is displaced upward.

Due to the displacement of the contact piece 11 by the releaser 15, the contacting state between the contact portion 17 of the contact piece 11 and the first terminal 3 is released, so that the electrical connection between the adjacent first terminals 3, 3 is released, and when the first housing 5 and the second housing 9 are engaged with each other, the first terminal 3 and the second terminal 7 are electrically connected.

When the first housing 5 and the second housing 9 are engaged with each other, that is, the first terminal 3 and the second terminal 7 are electrically connected to each other, the slide portion 19 of the contact piece 11 is in contact with a plane provided on the upper end side of the inclined surface of the releaser 15 so that the displaced state of the contact piece 11 is maintained and the contact portion 17 and the first terminal 3 are not brought into contact with each other and the short circuit terminal 13 and the first terminal 3 are not electrically connected.

In the displacement of the contact piece 11 by a sliding motion and contact between the slide portion 19 of the contact piece 11 and the releaser 15, the contact portion 17 is arranged away from the releaser 15 so as not to slide or come in contact with the releaser 15 from the time of release from the contacting state with the first terminal 3 until the first terminal 3 and the second terminal 7 are connected.

By arranging the contact portion 17 in this way, deformation of the contact portion 17 due to sliding with the releaser 15 can be prevented, and in the state in which the engagement between the first housing 5 and the second housing 9 has been released, the contact portion 17 and the first terminal 3 can be normally brought into contact with each other and the connection reliability between the short circuit terminal 13 and the first terminal 3 can be maintained.

In addition, even if an insulating substance is attached to the releaser 15, since the contact portion 17 does not slide on or come into contact with the releaser 15, the insulating substance does not adhere to the contact portion 17, so that it is possible to prevent an insulating substance from interposing between the contact portion 17 and the first terminal 3, and to maintain the connection reliability between the short circuit terminal 13 and the first terminal 3.

In the releaser 15, the insulation portion 21 is extended from a lower end of the inclined surface toward the first housing 5 side, and formed of a member continuous with the second housing 9.

The insulation portion 21 is arranged between the contact portion 17 and the first terminal 3 while being apart from the contact portion 17 in the state where the first housing 5 and the second housing 9 are engaged with each other.

By arranging the insulation portion 21 between the contact portion 17 and the first terminal 3 thus in the state where the first housing 5 and the second housing 9 are engaged with each other, insulating performance between the contact portion 17 and the first terminal 3 can be improved so that conduction between the short circuit terminal 13 and the first terminal 3 can be prevented.

In such a connector 1, the contact piece 11 has the contact portion 17 provided so as to be contactable with the first terminal 3 and the slide portion 19 provided so as to be positioned on the front side of the contact portion 17 in the engaging direction of the first housing 5 and the second housing 9 and to be slidable on the releaser 15, and thereby when the first housing 5 and the second housing 9 become engaged with each other, the slide portion 19 slides on the releaser 15 while being in contact with the releaser 15 so that the contact portion 17 does not slide on the releaser 15, and thus, deformation due to sliding of the contact portion 17 on the releaser 15 can be prevented.

Since the contact portion 17 is arranged to be apart from the releaser 15 when the slide portion 19 slides on the releaser 15 and the contact piece 11 is displaced, the contact portion 17 does not come in contact with the releaser 15 in the state where the first housing 5 and the second housing 9 are engaged with each other and the insulating substance attached to the releaser 15 can be prevented from adhering to the contact portion 17.

Therefore, in such a connector 1, in the state where the engagement between the first housing 5 and the second housing 9 has been released, the contact portion 17 and the first terminal 3 are normally brought into contact with each other, and no insulating substance is interposed between the contact portion 17 and the first terminal 3 so that the electrical performance of the short circuit terminal 13 can be maintained.

Since the insulation portion 21 arranged between the contact portion 17 and the first terminal 3 in the state where the first housing 5 and the second housing 9 are engaged with each other is provided in the releaser 15, the insulating property between the contact portion 17 and the first terminal 3 can be improved and conduction between the short circuit terminal 13 and the first terminal 3 can be prevented.

In the connector 1 according to the embodiment, the slide portion 19 is provided so that the free end of the contact piece 11 protrudes; however, the present invention is not limited to this, and for example, the slide portion 19 may be formed by integrally providing a sliding member having abrasion resistance or the like on the free end of the contact piece 11.

In this case, it is possible to prevent the contact piece 11 from being deformed by sliding of the slide portion 19 on the releaser 15, and to maintain the elastic deformation force of the contact piece 11, and thereby, to maintain the connection reliability between the short circuit terminal 13 and the first terminal 3.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connector comprising:

a first housing;

a plurality of first terminals housed in the first housing;

a second housing engageable with the first housing;

a plurality of second terminals housed in the second housing and connected to the plurality of first terminals respectively with the first housing and the second housing being engaged with each other;

a short circuit terminal housed in the first housing and having contact pieces contacting with adjacent first terminals of the plurality of first terminals respectively with the first housing and the second housing not being engaged with each other; and a releaser provided in the second housing and configured to displace the contact pieces and release contact between the adjacent first terminals and the contact pieces upon engaging of the first housing and the second housing, wherein the contact pieces comprise:

contact portions contactable with the adjacent first terminals respectively; and slide portions slidable on the releaser and respectively arranged in positions anterior to the contact portions in an engaging direction of the first housing and the second housing, and the contact portions are apart from the releaser with the contact pieces being displaced due to sliding of the slide portions on the releaser, wherein the releaser comprises an insulation portion arranged in between the contact portions and the adjacent first terminals and apart from the contact portions with the first housing and the second housing being engaged with each other.

2. The connector according to claim 1, wherein the plurality of first terminals are male terminals and the plurality of second terminals are female terminals.

3. The connector according to claim 1, wherein when the first terminal and the second terminal are engaged with each other, the slide portion of the contact piece is in contact with a place on an upper end side of an inclined surface of the releaser.

* * * * *